United States Patent [19]

Barker et al.

[11] Patent Number: 4,862,658

[45] Date of Patent: Sep. 5, 1989

[54] DOOR JAMB ALIGNMENT AND SECURITY APPARATUS

[75] Inventors: Rodney K. Barker, 3702 Colony Dr., San Antonio, Tex. 78230; William G. Barker, San Antonio, Tex.

[73] Assignee: Rodney K. Barker, San Antonio, Tex.

[21] Appl. No.: 93,306

[22] Filed: Sep. 3, 1987

[51] Int. Cl.[4] ..... E06B 1/18

[52] U.S. Cl. ..... 52/217; 49/505; 52/211; 52/732; 52/741; 292/340

[58] Field of Search ..... 52/213, 212, 217, 216, 52/204, 731, 741, 633, 732; 49/504, 505, 501, 503; 292/346, 340

[56] References Cited

U.S. PATENT DOCUMENTS

| | | | |
|---|---|---|---|
| 851,973 | 4/1907 | Aus | 52/732 |
| 1,179,597 | 4/1916 | Zahner . | |
| 1,962,826 | 6/1934 | MacDonald | 52/204 |
| 2,804,182 | 8/1957 | Roos | 49/504 |
| 2,834,066 | 5/1958 | Lybarger . | |
| 2,893,070 | 7/1959 | Gauthier | 49/505 |
| 2,924,861 | 2/1960 | Viets | 49/503 X |
| 3,248,833 | 5/1966 | Sklar . | |
| 3,571,995 | 3/1971 | Kasprzak . | |
| 3,654,734 | 4/1972 | Lehman | 49/505 |
| 3,906,671 | 9/1975 | Maldonado . | |
| 3,938,291 | 2/1976 | Criswell | 52/731 |
| 4,015,382 | 4/1977 | Noyes | 49/504 X |
| 4,251,962 | 2/1981 | Langenhorst | 49/504 |
| 4,484,411 | 11/1984 | Rystad . | |
| 4,489,527 | 12/1984 | Haas | 52/211 X |
| 4,717,185 | 1/1988 | Hartley | 292/340 |

FOREIGN PATENT DOCUMENTS

| | | | |
|---|---|---|---|
| 2265960 | 10/1975 | France | 49/505 |
| 369276 | 6/1963 | Switzerland | 52/212 |

*Primary Examiner*—John E. Murtagh
*Attorney, Agent, or Firm*—Richard J. Smith

[57] ABSTRACT

A method and apparatus for aligning a door jamb relative to a door frame and securing the jamb to the frame. A pair of frame members are secured to the hinge and knob sides of a door frame and a pair of jamb members are secured to the hinge and knob sides of a door jamb. Each frame member has a plate portion and a flange portion having a plurality of slots therethrough. Each jamb member has a plate portion and a flange portion having a plurality of threaded passages therethrough. The door jamb is positioned relative to the door frame so that the respective flange portions are adjacent to each other and the slots and threaded passages are aligned. A plurality of threaded bolts are thereafter inserted into the slots and threaded passages in substantially parallel alignment with the adjacent jamb member and the frame member plate portions, the door jamb is selectively positioned relative to the door frame, and the bolts are tightened. Cap members may thereafter be secured to adjacent frame and jamb members.

13 Claims, 4 Drawing Sheets

DOOR JAMB ALIGNMENT AND SECURITY APPARATUS

BACKGROUND OF THE INVENTION

The present invention relates to an apparatus and method for aligning and securing a door jamb.

Conventional wooden door framing generally comprises a hinge side cripple or door buck secured to an adjacent wall stud, a knob side cripple or door buck secured to an adjacent wall stud, and a frame header which extends across the tops of, and is connected to, the cripples. The door frame and floor supporting the frame define a door opening within which to receive a door jamb, to which a door is or may be connected. A conventional wooden door jamb comprises a hinge side adapted to be connected to the hinge side cripple, a knob side adapted to be connected to the knob side cripple, and a jamb header which extends between and is connected to the jamb sides on the uppermost ends thereof.

Although the door jamb may be properly aligned at the time it is initially installed within a door opening, a shifting foundation or other factor may cause the door jamb to lose its alignment, thereby causing the door to "stick" or fail to open and close properly. Further, loss of door jamb alignment may result in inefficient heating and/or cooling of the enclosure to which the door opening permits access and/or alter the proper operation of a locking mechanism associated with the door. Correction of such disalignment generally requires the costly procedure of removing the jamb from the frame and resetting the jamb. Alternatively, a portion of the door may be cut or planed down, thereby damaging the door. The foregoing realignment procedures are particularly undesirable in circumstances where it is necessary to repeatedly realign the door jamb. Further, the standard connection of a wooden door jamb to a wooden frame provides only minimal security against the unauthorized separation of the jamb from the door frame.

SUMMARY OF THE INVENTION

Accordingly, the present invention provides apparatus which may be installed between the sides of a door jamb and a door frame whereby the door jamb may be readily aligned and realigned without removing the jamb from the frame. Further, the apparatus of the present invention provides additional security against separation of the jamb from the door frame and the door from the jamb.

The present invention comprises a pair of identical frame members adapted to be secured to the hinge and knob sides of a door frame and a pair of identical jamb members adapted to be secured to the hinge and knob sides of a door jamb. Each frame member comprises a substantially planar plate portion and a flange portion which is substantially transverse to the plate portion. The frame member flange portion has a plurality of longitudinal or elongated slots therethrough. Each jamb member comprises a substantially planar plate portion and a flange portion which is substantially transverse to the plate portion. The flange portion has a plurality of threaded passages therethrough. In an alternate embodiment, a knob side jamb member is provided having a longitudinal channel for receiving the throw of a lock. The plate portion of each frame member and jamb member preferably has a longitudinal groove in each side edge thereof which is adapted to receive a cap member.

Installation of the apparatus of the present invention comprises the steps of securing the frame members to the hinge and knob sides of a door frame so that the frame member flange portions extend outward therefrom. The jamb members are secured to the outside of the hinge and knob sides of a door jamb so that the jamb member flange portions extend outward therefrom. The door jamb is thereafter inserted into the door opening so that the jamb member flange portions are adjacent to or abut against the frame member flange portions, with the frame member flanges being nearer to the "inside" of the door opening than the jamb member flanges, and the slots and threaded passages are aligned. A plurality of threaded bolts are thereafter inserted into the slots and threaded passages in substantially parallel alignment with the adjacent jamb member and frame member plate portions, the door jamb is aligned or selectively positioned relative to the door frame, and the bolts are tightened. The cap members are thereafter secured to the frame members and jamb members.

In the event the door jamb looses its alignment, it may be readily realigned by removing the appropriate cap members, loosening the appropriate bolts extending through the slots and threaded passages, moving or repositioning the door jamb relative to the door frame, retightening the loosened bolts, and resecuring the removed cap members. The slots in the frame member flange portions are adapted to permit horizontal and vertical movement of the jamb relative to the frame. The apparatus of the present invention provides additional security against separation of the door jamb from the door frame due to the position of the jamb member flange portions relative to the frame member flange portions. Additional security is also provided by the cap members which further secure the jamb to the frame. The apparatus of the present invention also provides an additional keeper for a lock throw.

DETAILED DESCRIPTION OF THE PREFERRED EMBODIMENT

Figure 1:
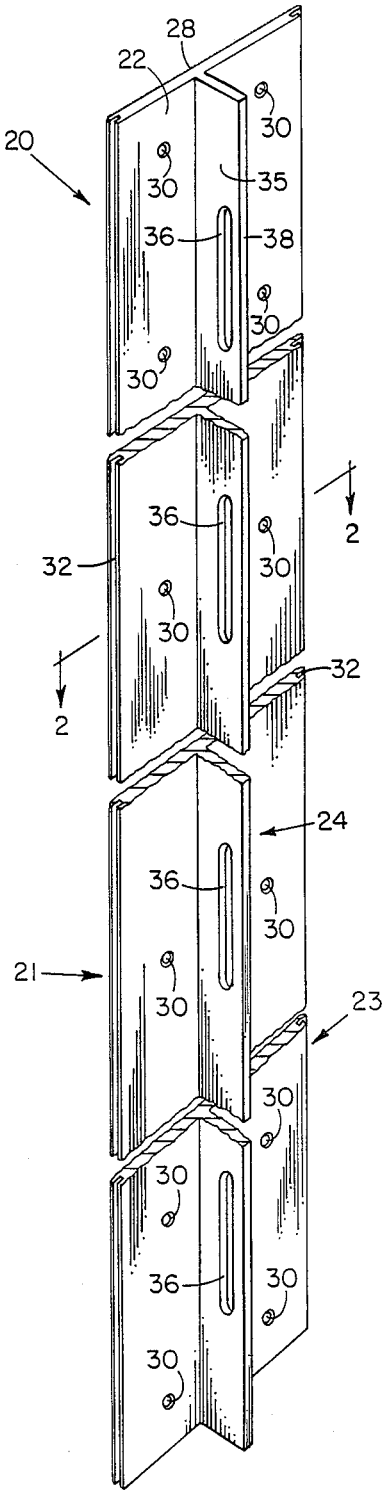
FIG. 1 is a broken perspective view of the preferred embodiment of a frame member of the present invention.
Figure 2:
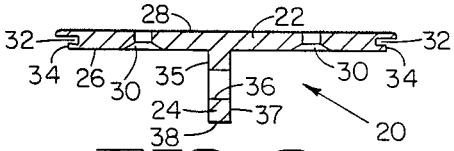
FIG. 2 is a cross sectional view of the preferred embodiment of a frame member of the present invention taken along section lines 2—2 of FIG. 1.

Referring to FIG. 1 and FIG. 2, a frame member of the present invention is identified by the number 20. Frame member 20 preferably comprises a unitary piece of extruded aluminum having a substantially planer plate portion 22 and a flange portion 24. Plate portion 22 has a first side edge 21 and a second side edge 23. Referring to FIG. 2, plate portion 22 has a front side or surface 26 and a rear side or surface 28. Rear side 28 is preferably serrated. Frame member 20 is further provided with a plurality of countersunk screw holes 30 which extend through plate portion 22 on each side of flange portion 24. Each side of plate portion 22 has a longitudinal groove 32 therein extending the entire length of frame member 20. As further illustrated in FIG. 2, the rear side 28 of plate portion 22 is wider than the front side 26 and each of the grooves 32 defines an inner lip 34. As further illustrated in FIG. 1 and FIG. 2, flange portion 24 is substantially transverse to plate portion 22 and has a plurality of longitudinal or elongated slots 36 extending therethrough. Flange 24 has a first side or surface 35 and a second, opposite side or surface 37 through which slots 36 extend. Flange portion 24 also has an outer edge 38.

Figure 3:
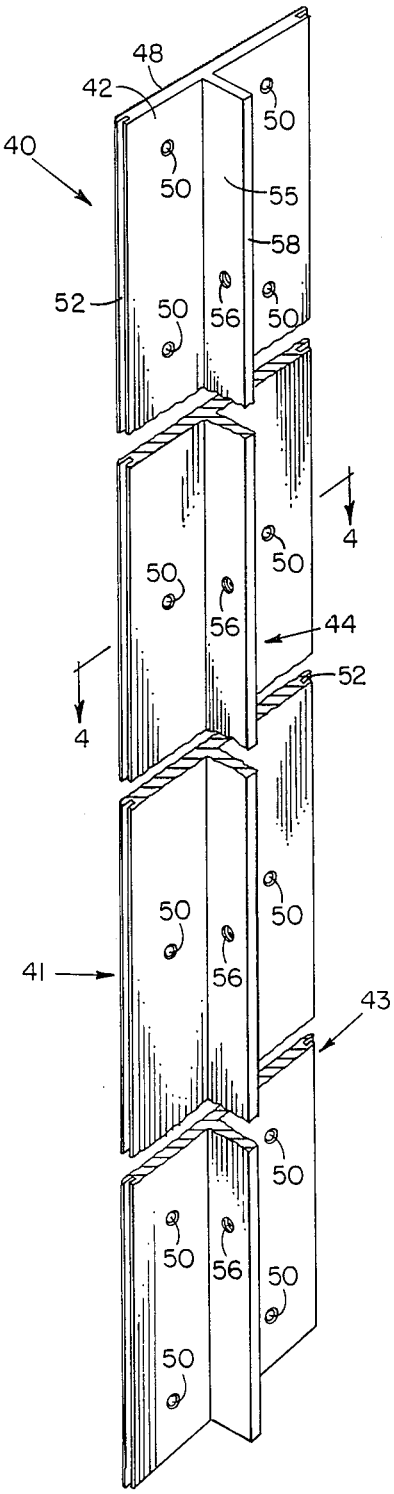
FIG. 3 is a broken perspective view of the preferred embodiment of a jamb member of the present invention.
Figure 4:
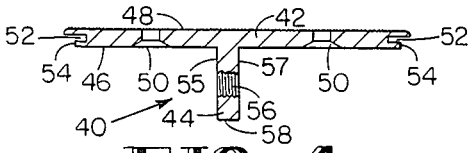
FIG. 4 is a cross sectional view of the preferred embodiment of a jamb member of the present invention taken along section lines 4—4 of FIG. 3.

Referring to FIG. 3 and FIG. 4, a jamb member of the present invention is identified by the number 40. Jamb member 40 preferably comprises a unitary piece of extruded aluminum having a plate portion 42 and a flange portion 44. Plate portion 42 has a first side edge 41 and a second side edge 43. As further illustrated in FIG. 4, plate portion 42 has a front side or surface 46 and a rear side or surface 48. Rear side 48 is preferably serrated. Plate portion 42 has a plurality of countersunk screw holes 50 extending therethrough on each side of flange portion 44. Each side edge of plate portion 42 has a longitudinal groove 52 therein extending the entire length of jamb member 40. As further illustrated in FIG. 4, the rear side 48 of plate portion 42 is wider than the front side 46 and each of the grooves 52 defines an inner lip 54. As further illustrated in FIG. 3 and FIG. 4, flange portion 44 is substantially transverse to plate portion 42 and has a plurality of threaded passages 56 extending therethrough. Flange 44 has a first side or surface 55 and a second, opposite side or surface 57 through which passages 56 extend. Flange portion 44 also has an outer edge 58.

Figure 5:
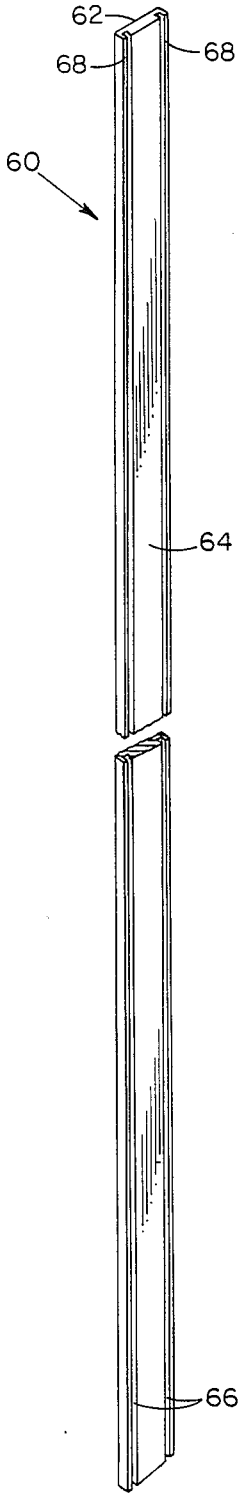
FIG. 5 is a broken perspective view of the preferred embodiment of a cap member of the present invention.
Figure 6:
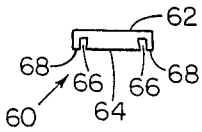
FIG. 6 is an end view of the preferred embodiment of a cap member of the present invention.

Referring to FIG. 5 and FIG. 6, a cap member of the present invention is identified by the number 60. Cap member 60 preferably comprises a unitary piece of extruded aluminum having an outer side or surface 62 and an inner side or surface 64. Cap member 60 has a pair of longitudinal grooves 66 therein which extend the entire length of cap member 60 on each side thereof. Grooves 66 define a pair of outer lips 68 which extend the entire length of cap member 60 on each side thereof.

Figure 7:
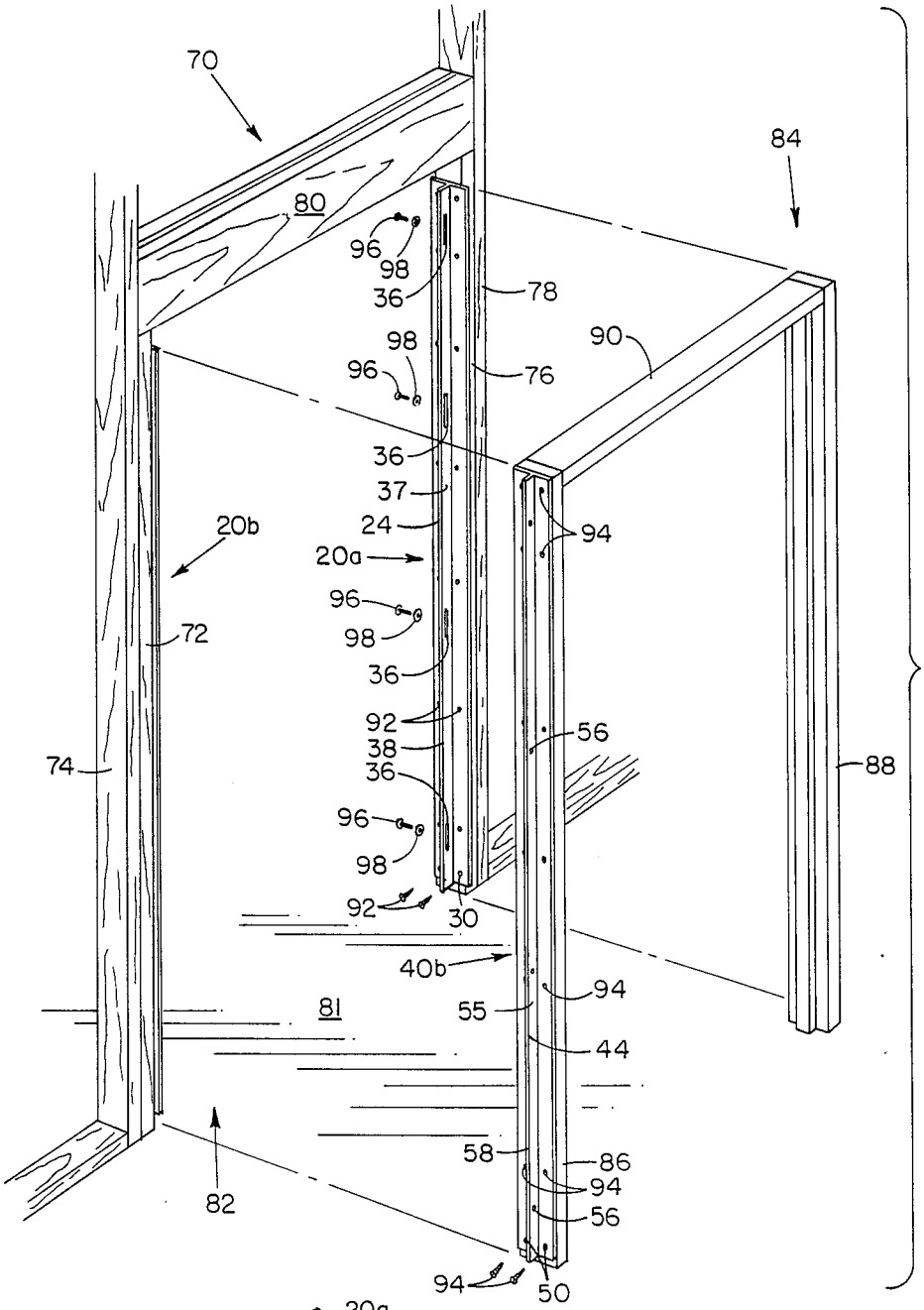
FIG. 7 is a perspective view from the "outside" of a door opening illustrating the installation of the present invention.

Referring to FIGS. 7–10, the installation and usage of the present invention will be described in greater detail. Referring to FIG. 7, a wooden door frame is identified by the number 70. Door frame 70 comprises a substantially vertical hinge side cripple or door buck 72 which is nailed or otherwise appropriately connected to an adjacent stud 74. Frame 70 further comprises a substantially vertical knob side cripple or door buck 76 which is nailed or otherwise appropriately connected to an adjacent stud 78. Finally, frame 70 comprises a substantially horizontal frame header 80 which extends across the tops of, and is nailed or otherwise appropriately connected to, door bucks 72 and 76. Frame 70 is supported by a floor 81. Floor 81, door bucks 72 and 76, and header 80 define a door opening 82.

Referring again to FIG. 7, a wooden door jamb adapted to be received within door opening 82 is identified by the number 84. Jamb 84 comprises a substantially vertical hinge side 86 and a substantially vertical knob side 88. Jamb sides 86 and 88 are connected on the uppermost ends thereof by a jamb header 90 which extends between, and is nailed or otherwise appropriately connected to, jamb sides 86 and 88. For purposes of clarity, no door is shown connected to jamb 84 in FIG. 7.

Figure 8:
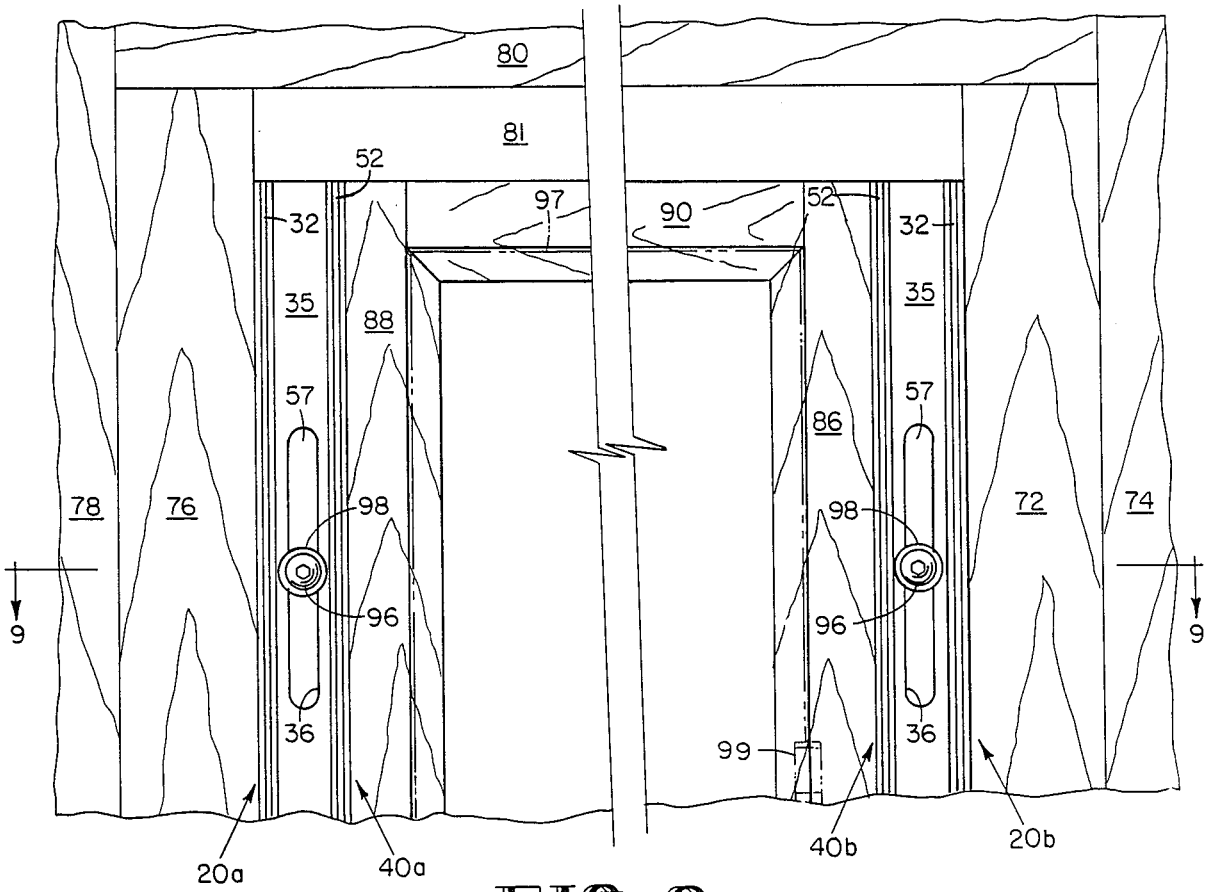
FIG. 8 is a partial elevational view from the "inside'-'of a door opening further illustrating the installation of the present invention.

It is to be understood that jamb 84 is illustrated in FIG. 7 on the "outside" of opening 82. Further, it is to be understood that FIG. 8 is a partial elevational view from the "inside" of opening 82. Finally, it is to be understood that, as used herein, the "outside" of opening 82 refers to the exterior of the structure or enclosure to which opening 82 permits access and the "inside" of opening 82 refers to the interior of the structure or enclosure to which opening 82 permits access.

Figure 9:
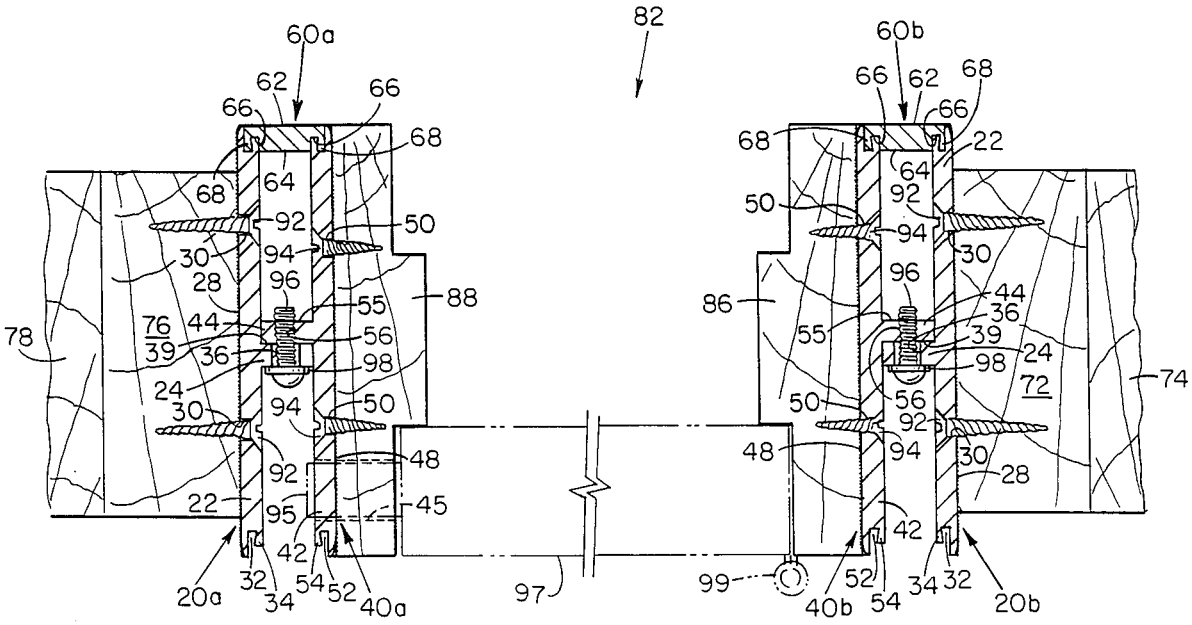
FIG. 9 is a cross sectional view taken along section lines 9—9 of FIG. 8 further illustrating the installation of the present invention.

Referring to FIG. 7 nd FIG. 9, the installation of the present invention comprises the steps of securing a frame member 20*a* to door buck 76 and securing an identical frame member 20*b* to door buck 72. It is to be understood that frame 70 is preferably plumb or properly aligned prior to the securement of frame members 20*a* and 20*b* thereto. It is also to be understood that frame members 20*a* and 20*b* are identical to frame member 20 described hereinabove and that identical numbers are utilized to identify features described in connection with frame member 20. The securement of frame members 20*a* and 20*b* to door bucks 76 and 72, respectively, is preferably accomplished by gluing the respective rear sides 28 to door bucks 76 and 72 and screwing wood screws 92 into door bucks 76 and 72 through countersunk holes 30 in members 20*a* and 20*b*, respectively. The serration of rear sides 28 of members 20*a* and 20*b* facilitates securement to bucks 76 and 72, respectively. Once installed, the bottom edges of members 20*a* and 20*b* are preferably approximately one and one half inches (1½") from the bottom edges of door bucks 76 and 72, respectively, and the top edges of members 20*a* and 20*b* are preferably at least one inch (1") from header 80.

Referring again to FIG. 7 and FIG. 9, the installation of the present invention further comprises the steps of securing a jamb member 40*b* to the outer surface of jamb side 86 and securing an identical jamb member 40*a* (not shown in FIG. 7) to the outer surface of jamb side 88. It is to be understood that jamb members 40*a* and 40*b* are identical to jamb member 40 described hereinabove and that identical numbers are utilized to identify features described in connection with jamb member 40. The securement of jamb members 40*a* nd 40*b* to jamb sides 88 and 86, respectively, is preferably accomplished by gluing the respective rear sides 48 to jamb sides 88 and 86 and screwing wood screws 94 into jamb sides 88 and 86 through countersunk holes 50 in members 40*a* and 40*b*, respectively. The serration of rear sides 48 of members 40*a* and 40*b* facilitates securement to jamb sides 88 and 86, respectively. Once installed, the top edges of members 40*a* and 40*b* are preferably flush with the top edges of sides 88 and 86, respectively, and the bottom edges of members 40*a* and 40*b* are preferably approximately one and one half inches (1½") from the bottom edges of sides 88 and 86, respectively.

Referring to FIGS. 7–10, the jamb 84, having jamb members 40*a* and 40*b* connected thereto, is thereafter inserted into door opening 82 so that flange 44 of jamb member 40*a* is adjacent to or abuts against flange 24 of frame member 20*a*, flange 44 of jamb member 40*b* is adjacent to or abuts against flange 24 of frame member 20*b*, threaded passages 56 in jamb member 40*a* are aligned with the corresponding slots 36 in frame member 20*a*, and threaded passages 56 in jamb member 40*b* are aligned with the corresponding slots 36 in frame member 20*b*. Flanges 24 are preferably nearer to the "inside" of opening 82 than flanges 44. Surface 35 of each flange 24 preferably faces the "inside" of opening 82 whereas surface 55 of each flange 44 preferably faces the "outside" of opening 82. The shafts of a plurality of threaded bolts 96 are thereafter inserted through slots 36 in members 20*a* and 20*b* and threaded into the corresponding passages 56 in members 40*a* and 40*b*, respectively. Bolts 96 are inserted through slots 36 from the "inside" of door opening 82 and threaded into the corresponding passages 56 so as to be tightened slightly. A plurality of washers 98 are each preferably positioned about each one of the bolts 96 intermediate to the heads of bolts 96 and flanges 24. The jamb 84 is thereafter appropriately moved or selectively positioned horizontally and/or vertically relative to door frame 70 so that jamb 84 is properly aligned relative to frame 70. The bolts 96 are thereafter further tightened so as to secure jamb 84 to frame 70 in its selected position relative to frame 70. When jamb 84 is properly secured to frame 70, the plurality of washers 92 abut tightly against flanges 24, flange 24 of member 20*a* is flush with flange 44 of member 40*a*, and flange 24 of member 20*b* is flush with flange 44 of member 40*b*. As illustrated in FIG. 9, the shafts of threaded bolts 96 are substantially parallel to plate portions 22 and 42 and are substantially transverse to flanges 24 and 44 when the shafts of bolts 96 are received within slots 36 and passages 56.

Figure 10:
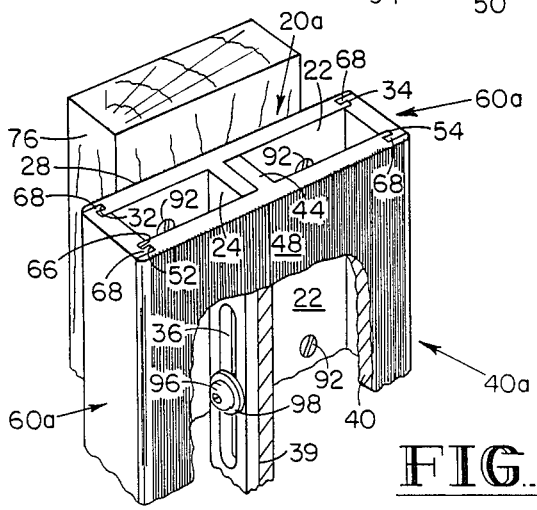
FIG. 10 is a perspective,, partially cut away, view further illustrating the installation of the present invention.
Figure 13:
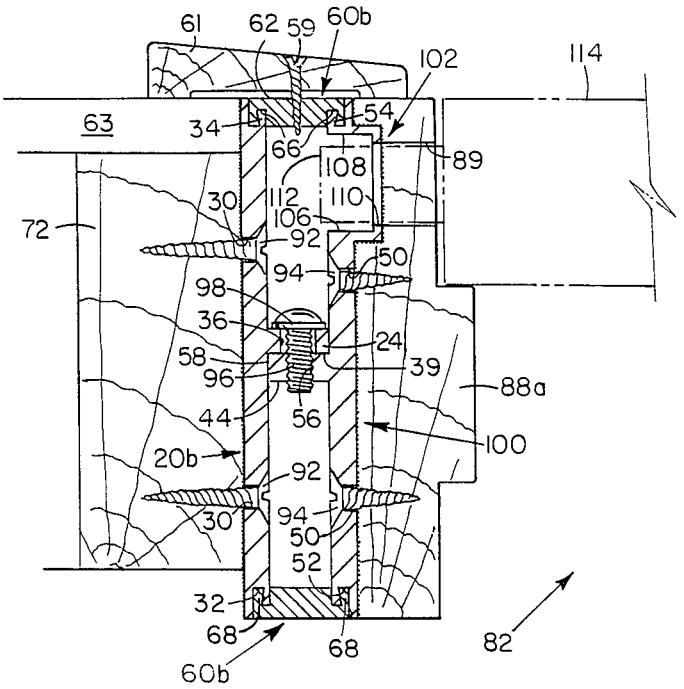
FIG. 13 is a cross sectional view illustrating the installation of an alternate embodiment of a jamb member.

Referring to FIG. 9 and FIG. 10, a pair of cap members 60*a* are thereafter secured to frame member 20*a* and jamb member 40*a* in a snap fit by inserting the respective lips 68 of each of the cap members 60*a* into groove 32 of frame member 20*a* and adjacent groove 52 of jamb member 40*a*. Lips 34 and 54 of member 20*a* and member 40*a*, respectively, are also inserted into the corresponding grooves 66 in cap members 60*a*. Once secured to frame member 20*a* and jamb member 40*a*, the outer surfaces 62 of the respective cap members 60*a* are preferably flush with the outer perimeter of side edges 21 and 43 and side edges 41 and 23, respectively. A pair of cap members 60*b* (only one of which is illustrated in FIG. 9) are also secured to frame member 20*b* and jamb member 40*b* in a snap fit by inserting the respective lips 68 of each of the cap members 60*b* into groove 32 of frame member 20*b* and adjacent groove 52 of jamb member 40*b*. Lips 34 and 54 of member 20*b* and member 40*b*, respectively, are also inserted into the corresponding grooves 66 in cap members 60*b*. Once secured to frame member 20*b* and jamb member 40*b*, the outer surfaces 62 of the respective cap members 60*b* are preferably flush with the outer perimeter of side edges 21 and 43 and side edges 41 and 23, respectively. It is to be understood that cap members 60*a* and 60*b* are identical to cap member 60 described hereinabove and that identical numbers are utilized to identify features described in connection with cap member 60. Further, as illustrated in FIG. 13, interior trim 61 may be appropriately secured, such as by one or more screws 59, to the interior cap members 60*a* and 60*b* whose outer sides 62 face the "inside" of opening 82. As further illustrated in FIG. 13, interior panelling or drywall material 63 may be appropriately secured to frame 70. The "outside" of opening 82 may also be appropriately finished out so as to cover the exterior caps 60*a* and 60*b* whose outer sides 62 face the "outside" of opening 82. Finally, once jamb 84 is appropriately aligned and a door 97 is properly connected to jamb 84, such as by a hinge 99 on the "inside" of door opening 82, a passage 45 (shown in hidden lines in FIG. 9) may be drilled through jamb side 88 and plate portion 42 of jamb member 40*a* for receiving therethrough the throw 95 of a lock secured to door 97.

In the event jamb 84 subsequently looses its alignment, jamb 84 may be readily realigned relative to frame 70 by removing the appropriate cap members 60*a* and/or 60*b*, loosening the appropriate bolts 96 without removing such bolts 96 from slots 36 and passages 56, repositioning jamb 84 relative to frame 70 so that jamb 84 is properly aligned relative to frame 70, and retightening the loosened bolts 96 so as to properly secure the repositioned jamb 84 to frame 70 in its selected position relative to frame 70. The removed caps 60*a* and/or 60*b* may thereafter be resecured to members 20*a* and 40*a* and/or members 20*b* and 40*b*, respectively. It is to be understood that the length of slots 36 and width of slots 36 relative to the diameter of the shafts of threaded bolts 96 permits horizontal positioning and vertical positioning, respectively, of a door jamb relative to a door frame when the shafts of bolts 96 are received through slots 36 and within passages 56. It is also to be understood that the gap 81 between header 80 and jamb 84 allows either or both sides of jamb 84 to be raised relative to frame 70. It is also to be understood that the spacing between the bottom edges of members 40*a* and 40*b* and the bottom edges of jamb sides 88 and 86, respectively, allows the jamb sides 88 and/or 86 to be lowered relative to frame 70 by cutting off a portion of the bottom of the respective jamb side(s) desired to be lowered. Finally, it is to be understood that only the caps 60*a* and/or 60*b* on the side(s) of jamb 84 to be repositioned need to be removed during the realignment process and that only the bolts 96 on the side(s) of jamb 84 to be repositioned need to be loosened during the realignment process.

It is to be understood that the widths of rear sides 28 and 48 are approximately identical and that the thicknesses of flanges 24 and 44 between sides 35 and 37 and sides 55 and 57, respectively, are approximately identical. It is also to be understood that the distance or width between the perimeter of rear side 28 along first side edge 21 and first surface 35 of flange 24 is shorter or less than the distance or width between the perimeter of rear side 28 along second side edge 23 and second surface 37 of flange 24. Further, the distance or width between the perimeter of rear side 48 along first side edge 41 and first surface 55 of flange 44 is shorter or less than the distance or width between the perimeter of rear side 48 along second side edge 43 and second surface 57 of flange 44. The distance or width between the perimeter of rear side 28 along first side edge 21 and first surface 35 is approximately identical to the distance or width between the perimeter of rear side 48 along first side edge 41 and first surface 55. The distance or width between the perimeter of rear side 28 along second side edge 23 and second surface 37 is approximately identical to the distance or width between the perimeter of rear side 48 along second side edge 43 and second surface 57. Accordingly, when flanges 24 are flush with flanges 44, as illustrated in FIG. 9 and FIG. 10, the line of interface 39 between flanges 24 and 44 will be in approximately the center of plate portions 22 and 42.

Figure 11:
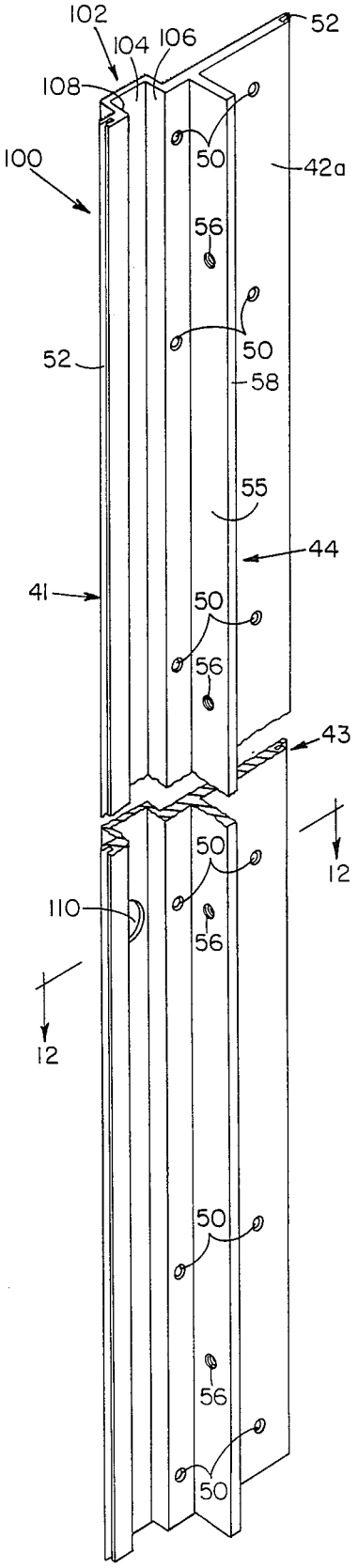
FIG. 11 is a broken perspective view of an alternate embodiment of a jamb member.
Figure 12:
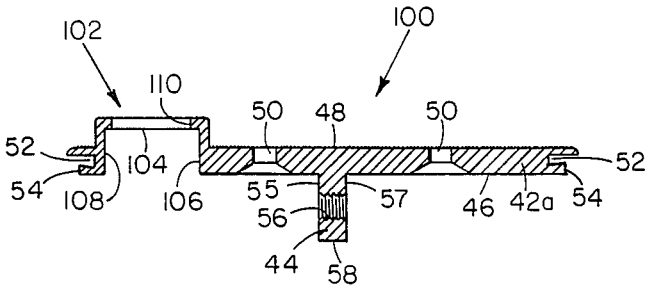
FIG. 12 is a cross sectional view of an alternate embodiment of a jamb member taken along section lines 12—12 of FIG. 11.

Referring to FIGS. 11–13, an alternate embodiment of a jamb member for securement to the lock or knob side of a door jamb is identified by the number 100, with like numbers being utilized to identify features discussed in connection with jamb member 40. A modified plate portion **42*a* is provided with a longitudinal channel 102 on one side of flange 44. Channel 102 has a bottom 104 and a pair of opposed side walls 106 and 108. A passage 110 adapted to receive a lock throw 112 therethrough extends through bottom 104. Except as described herein, jamb member 100 is identical to jamb member 40**.

As illustrated in FIG. 13, jamb member 100 is preferably secured to a jamb side **88*a* by gluing rear side 48 to jamb side 88*a* and screwing a plurality of wood screws 94 through passages 50 into jamb side 88*a*. Jamb side 88*a* is adapted to receive channel 102 and has a passage 89 therethrough which is aligned with passage 110 when member 100 is properly secured to jamb side 88*a*. Further, jamb member 100 is preferably secured to jamb side 88*a* so as to allow a lock throw 112 from a door 114 to be inserted through passage 89 and passage 110 and be received within channel 102 intermediate side walls 106 and 108. Channel 102 provides an additional keeper and an additional security feature to impede dislodgment of the throw 112 from the door jam with which jamb side 88*a* is associated. That is, throw 112 will extend through the standard keeper (not shown) and through plate portion 42*a* to be received within channel 102**.

It is to be understood that the position of door 114 referenced in FIG. 13 is reversed from the position of door 97 referenced in FIG. 9. That is, the knob or lock side of door 114 is on the right side of opening 82 as viewed from the "inside" of opening 82, with door buck 72 serving as the knob or lock side door buck. Further, jamb member 100 is connected to frame member **20*b* in the same manner as jamb member 40*b* is connected to frame member 20*b*. Finally, cap members 60*b* may be connected to frame member 20*b* and jamb member 100 in the same manner as cap members 60*b* are connected to frame member 20*b* and jamb member 40*b*. Accordingly, the jamb member 100** may be utilized to permit alignment and realignment of the door jamb as described hereinabove.

It is to be understood that, in addition to the securement of flanges 24 to flanges 44 by bolts 96, the position of frame member flanges 24 relative to jamb member flanges 44, as illustrated in FIGS. 8–10 and described hereinabove, provides additional security against the separation of jamb 84 from frame 70 from the "outside" of opening 82 by means of the exertion of a force against jamb 84 from the "outside" of opening 82. Further, the preferred embodiment of the present invention provides additional security against the unauthorized removal of jamb 84 from frame 70 in that it only permits access to the heads of bolts 96 for the removal or adjustment of jamb 84 from the "inside" of opening 82. Further, the securement of caps **60*a* to adjacent members 20*a* and 40*a* and the securement of caps 60*b* to adjacent members 20*b* and 40*b* provides further security against separation of jamb 84 from frame 70. Finally, the passage 45 which may be drilled in plate portion 42 of jamb member 40*a* provides an additional keeper and additional security against the dislodgment of throw 95 from jamb 84. That is, throw 95 will extend through the standard keeper (not shown) and plate portion 42. In the event the present invention is desired to be used primarily for jamb alignment purposes, slots 36 may extend through jamb member flanges 44 and passages 56 may extend through frame member flanges 24 and/or jamb member flanges 44 may be nearer to the "inside"of opening 82 than frame member flanges 24**.

In the preferred embodiment, frame member 20 has a length of approximately six feet eight inches (6'8") and flange 24 is preferably provided with four slots 36. Each slot 36 preferably has a length of approximately three inches (3") and a width of approximately three-eights inch ($\frac{3}{8}$"). Finally, the centers of the two outermost slots 36 are approximately four inches (4") from the nearest end (top or bottom) of frame member 20 and the centers of the two innermost slots 36 are approximately twenty-eight inches (28") from the nearest end (top or bottom) of frame member 20.

In the preferred embodiment, rear sides 28 and 48 have a width of approximately six feet eight inches (6'8") and flange 44 has four threaded passages 56 therethrough. Further, passages 56 preferably have a diameter of approximately one fourth inch (1/4"). Finally, the centers of the two outermost passages 56 are preferably approximately four inches (4") from the nearest end (top or bottom) of jamb member 40 and the centers of the two innermost passages 56 are preferably approximately twenty eight inches (28") from the nearest end (top or bottom) of jamb member 40.

In the preferred embodiment, rear sides 28 and 48 have a width of approximately four and one half inches ($4\frac{1}{2}$") and front sides 26 and 46 have a width of approximately four and one fifth inches (4 1/5") between the perimeters of lips 34 and 54, respectively. The distance or width between the perimeter of rear side 28 along edge 21 and flange side 35 and the distance or width between the perimeter of rear side 48 along edge 41 and flange side 55 is preferably approximately two inches (2"). The distance or width between the perimeter of rear side 28 along edge 23 and flange side 37 and the distance or width between the perimeter of rear side 48 along edge 43 and flange side 57 is preferably approximately two and one quarter inches ($2\frac{1}{4}$"). The thickness of flanges 24 and 44 between sides 35 and 37 and sides 55 and 57, respectively, is preferably approximately one fourth inch ($\frac{1}{4}$").

It is to be understood that cap 60 preferably has a length of approximately six feet eight inches (6'8"), a width of approximately one inch (1"), and a thickness between outer side 62 and inner side 64 of approximately one fourth inch ($\frac{1}{4}$"). It is also to be understood that the width of each of the lips 68 is slightly greater than the width of grooves 32 and 52 so that cap 60 can be secured to a frame member 20 and an adjacent jamb member 40, as described hereinabove, in a snap fit. Further, it is to be understood that trim 61 may extend the entire length of cap 60 and cover the outer side 62 of cap 60. Finally, it is to be understood that when trim 61 is secured to a cap member 60, as illustrated in FIG. 13, cap 60 and trim 63 provide a removable snap lock trim.

It is to be understood that bolts 96 are preferably of the Allen head type and that washers 98 may be eliminated in the event that the heads of bolts 96 have a greater diameter than the width of slots 36. Further, it is to be understood that the shafts of bolts 96 preferably have a diameter of approximately one fourth inch (¼"). Finally, it is to be understood that a passage adapted for receiving a lock throw therethrough may be drilled or cut in jamb member 40 prior to the securement of member 40 to a door jamb.

It is to be understood that the corresponding dimensions of frame member 20 and jamb member 40 permit usage of frame member 20 on either side of frame 70 and jamb member 40 on the outer surface of either side of jamb 84. However, a particular frame member 20 which would be appropriately secured to one side of frame 70 must be turned upside down to be appropriately secured to the opposite side of frame 70. Likewise, a particular jamb member 40 which would be appropriately secured to one side of jamb 84 must be turned upside down to be appropriately secured to the opposite side of jamb 84. Further, it is to be understood that appropriate insulation material, such as styrofoam or rubber, may be placed in the respective cavities between flanges 44 and caps **60*a* and 60*b* and the respective cavities between flanges 24 and caps 60*a* and 60*b* prior to the securement of caps 60*a* to members 20*a* and 40*a* and caps 60*b* to members 20*b* and 40*b*. Finally, it is to be understood that frame member 20, jamb member 40, jamb member 100, and cap member 60** may be constructed of steel, wood, or other type of sturdy material.

It is to be understood that the door jamb alignment and security apparatus of the present invention may be utilized with preexisting or new construction. In the former case, it may be necessary to appropriately modify (increase or decrease) the distance between the door jamb and the door frame. It is also to be understood that the dimensions and specifications recited for frame member 20, jamb member 40, and cap member 60 are the preferred dimensions and specifications for utilization of the door jamb alignment and security apparatus of the present invention within a common residential door opening. In the event that the dimensions and specifications are altered to accommodate a particular door opening, the slots 36 and passages 56 on the hinge side of the door opening should preferably be located near the door hinges for strength purposes. It is also to be understood that the door jamb alignment and security apparatus of the present invention may be sold as a kit comprising two frame members 20, two jamb members 40, and four cap members 60. A plurality of threaded bolts 96, a plurality of washers 98, and a plurality of screws 92 and 94 may also be included as part of the kit. Finally, it is to be understood that jamb members 20 or 100 may be connected to or integral with a prehung or prefabricated door jamb assembly.

While the door jamb alignment and security apparatus has been described in connection with the preferred embodiment, it is not intended to limit the invention to the particular form set forth, but on the contrary, it is intended to cover such alternatives, modifications, and equivalents, as may be included within the spirit and scope of the invention as defined by the appended claims.

We claim:

1. Jamb alignment and security apparatus, comprising:

first and second frame members adapted to be secured to first and second sides of a frame, respectively, each of said frame members comprising a plate portion and a flange portion substantially transverse to said plate portion, each of said frame member flange portions having a plurality of frame member passages therethrough; and first and second jamb members adapted to be secured to a jamb on first and second sides of said jamb, respectively, each of said jamb members comprising a plate portion and a flange portion substantially transverse to said plate portion, each of said jamb member flange portions having a plurality of jamb member passages therethrough, each of said jamb member passages being adapted for alignment with one of said frame member passages, each of said frame member passages and jamb member passages being adapted for receiving therein a shaft of a bolt member substantially transverse to said flanges through which said frame member passages and jamb member passages extend, wherein each frame member plate portion has a pair of side edges and a longitudinal groove in each of said side edges and wherein each of said jamb member plate portions has a pair of side edges and a longitudinal groove in each of said side edges.

2. Jamb alignment and security apparatus, comprising:

first and second frame members adapted to be secured to first and second sides of a frame, respectively, each of said frame members comprising a plate portion and a flange portion substantially transverse to said plate portion, each of said frame member flange portions having a plurality of frame member passages therethrough;

first and second jamb members adapted to be secured to a jamb on first and second sides of said jamb, respectively, each of said jamb members comprising a plate portion and a flange portion substantially transverse to said pate portion, each of said jamb member flange portions having a plurality of jamb member passages therethrough, each of said jamb member passages being adapted for alignment with one of said frame member passages, each of said frame member passages and jamb member passages being adapted for receiving therein a shaft of a bolt member substantially transverse to said flanges through which said frame member passages and jamb member passages extend; and a plurality of cap members, each of said cap members being adapted to be secured to a frame member and a jamb member adjacent to said frame member.

3. A method for aligning and securing a door jamb relative to a door frame, comprising the steps of:

securing first and second frame members to the hinge and knob sides of said door frame, respectively, each of said frame members comprising a plate portion and a flange portion substantially transverse to said plate portion, each of said frame member flange portions having a first side, a second side, and a plurality of frame member flange passages therethrough;

securing first and second jamb members to said door jamb on the hinge and knob sides of said jamb, respectively, each of said jamb members comprising a plate portion and a flange portion substantially transverse to said plate portion, each of said jamb member flange portions having a first side, a second side, and a plurality of jamb member flange passages therethrough, each of said jamb member flange passages being adapted for alignment with one of said frame member flange passages, each of said frame member flange passages and jamb member flange passages being adapted for receiving therein a shaft of a bolt member substantially transverse to said flanges through which said frame member flange passages and jamb member flange passages extend;

aligning said frame member flange passages of said first frame member with said jamb member flange passages of said first jamb member and aligning said frame member flange passages of said second frame member with said jamb member flange passages of said second jamb member;

inserting a bolt member through each of said frame member flange passages and inserting said bolt member into said jamb member flange passage aligned with said frame member flange passage;

selectively positioning said door jamb relative to said door frame after said steps of securing said frame members and said jamb members to said door frame and door jamb, respectively; and tightening said bolt members so as to secure said jamb in said selected position relative to said frame.

4. A method for aligning and securing a door jamb relative to a door frame, comprising the steps of:

securing first and second frame members to the hinge and knob sides of said door frame, respectively, each of said frame members comprising a plate portion and a flange portion substantially transverse to said plate portion, each of said frame member flange portions having a first side, a second side, and a plurality of longitudinal slots therethrough;

securing first and second jamb members to said door jamb on the hinge and knob sides of said jamb, respectively, each of said jamb members comprising a plate portion and a flange portion substantially transverse to said plate portion, each of said jamb member flange portions having a first side, a second side, and a plurality of threaded passages therethrough, each of said passages being adapted for alignment with one of said slots, each of said slots and passages being adapted for receiving therein a shaft of a threaded bolt member substantially transverse to said flanges through which said slots and passages extend;

aligning said slots of said first frame member with said passages of said first jamb member and aligning said slots of said second frame member with said passages of said second jamb member;

inserting a threaded bolt member through each of said slots and threading said bolt member into said passage aligned with said slot;

selectively positioning said door jamb relative to said door frame;

tightening said threaded bolt members so as to secure said jamb in said selected position relative to said frame; and securing a cap member to each frame member and each jamb member adjacent to said frame member.

5. A method for aligning and securing a door jamb relative to a door frame, comprising the steps of:

securing first and second frame members to the hinge and knob sides of said door frame, respectively, each of said frame members comprising a plate portion and a flange portion substantially transverse to said plate portion, each of said frame member flange portions having a first side, a second side, and a plurality of longitudinal slots therethrough;

securing first and second jamb members to said door jamb on the hinge and knob sides of said jamb, respectively, each of said jamb members comprising a plate portion and a flange portion substantially transverse to said plate portion, each of said jamb member flange portions having a first side, a second side, and a plurality of threaded passages therethrough, each of said passages being adapted for alignment with one of said slots, each of said slots and passages being adapted for receiving therein a shaft of a threaded bolt member substantially transverse to said flanges through which said slots and passages extend;

aligning said slots of said first frame member with said passages of said first jamb member and aligning said slots of said second frame member with said passages of said second jamb member;

inserting a threaded bolt member through each of said slots and threading said bolt member into said passage aligned with said slot;

selectively positioning said door jamb relative to said door frame; and tightening said threaded bolt members so as to secure said jamb in said selected position relative to said frame, wherein said frame member flange portions are positioned relative to said jamb member flange portions so that after said tightening step said second sides of said frame member flange portions are flush with said second sides of said jamb member flange portions and said frame member flange portions are nearer to an inside of a door opening defined by said door frame than said jamb member flange portions.

6. Door jamb alignment and security apparatus, comprising:

first and second frame members adapted to be secured to the hinge and knob sides of a door frame, respectively, each of said frame members comprising a plate portion and a flange portion substantially transverse to said plate portion, each of said frame member flange portions having a plurality of longitudinal slots therethrough, each of said frame member plate portions having a pair of side edges and a longitudinal groove in each of said side edges extending the entire length of said plate portions;

first and second jamb members adapted to be secured to a door jamb on the hinge and knob sides of said jamb, respectively, each of said jamb members comprising a plate portion and a flange portion substantially transverse to said plate portion, each of said jamb member flange portions having a plurality of threaded passages therethrough, each of said passages being adapted for alignment with one of said slots, each of said slots and passages being adapted for receiving therein a shaft of a bolt member substantially transverse to said flanges through which said slots and threaded passages extend, said slots being adapted to permit horizontal and vertical movement of said jamb relative to said frame when a plurality of said bolt members are received within said slots and said passages, each of said jamb member plate portions having a pair of side edges and a longitudinal groove in each of said side edges extending the entire length of said plate portions; and a plurality of cap members, each of said cap members having a first and second lip on opposite sides thereof adapted to be received within one of said longitudinal grooves of one of said frame members and one of said longitudinal grooves of an adjacent one of said jamb members, respectively.

7. A kit for installing a door jamb alignment and security apparatus, comprising: first and second frame members adapted to be secured to the hinge and knob sides of a door frame, respectively, each of said frame members comprising a plate portion and a flange portion substantially transverse to said plate portion, each of said frame member flange portions having a plurality of longitudinal slots therethrough;

first and second jamb members adapted to be secured to a door jamb on the hinge and knob sides of said jamb, respectively, each of said jamb members comprising a plate portion and a flange portion substantially transverse to said plate portion, each of said jamb member flange portions having a plurality of threaded passages therethrough, each of said passages being adapted for alignment with one of said slots, each of said slots and passages being adapted for receiving therein a shaft of a bolt member substantially transverse to said flanges through which said slots and passages extend; and four cap members, each of which is adapted to be secured to a frame member and a jamb member adjacent to said frame member.

8. A kit, as recited in claim 7, further comprising a plurality of threaded bolt members for securing said first frame member to said first jamb member and said second frame member to said second jamb member.

9. A kit, as recited in claim 7, further comprising a plurality of screw members for securing said first and second frame members to said hinge and knob sides of said door frame, respectively, and for securing said first and second jamb members to said hinge and knob sides of said door jamb, respectively.

10. A knob side of a door jamb, said knob side comprising a jamb member and a knob side member, said jamb member comprising a plate portion and a protruding portion, said plate portion being connected to said knob side member substantially flush therewith and said protruding portion being received within a groove in said knob side member, whereby said protruding portion protrudes inward from said plate portion into said groove in said knob side member, said protruding portion having a first passage therethrough and said knob side member having a second passage therethrough, said first and second passages being substantially aligned and being adapted to receive a lock throw therein substantially transverse to said plate portion, wherein said jamb member plate portion has a pair of side edges and a longitudinal groove in each of said side edges.

11. A method for aligning a jamb relative to a frame, comprising the steps of:

loosening a plurality of bolts, each of said bolts being received within a passage in a flange portion of a frame member and a passage in a flange portion of a jamb member, said bolts having shafts substantially transverse to said frame member flange portion and said jamb member flange portion, said frame member being secured to said frame and said jamb member being secured to said jamb;

selectively positioning said jamb relative to said frame without removing said bolts from said frame member passages or said jamb member passages and after said frame member and jamb member have been secured to said frame and jamb, respectively; and retightening said plurality of bolts.

12. A jamb member, comprising a plate portion and a protruding portion, said protruding portion having a passage therethrough adapted to receive a lock throw therein substantially transverse to said plate portion, said plate portion being adapted to be connected to a knob side of a door jamb substantially flush therewith and said protruding portion being adapted to be received within a groove in said knob side of said door jamb, whereby said protruding portion protrudes inward from said plate portion into said groove in said knob side of said door jamb, wherein said plate portion has a pair of side edges and a longitudinal groove in each of said side edges.

13. Jamb alignment apparatus, comprising:

a frame member adapted to be secured to a frame, said frame member comprising a plate portion and a flange portion substantially transverse to said plate portion, said frame member flange portion having a plurality of frame member passages therethrough; and a jamb member adapted to be secured to a jamb, said jamb member comprising a plate portion and a flange portion substantially transverse to said plate portion, said jamb member flange portion having a plurality of jamb member passages therethrough, each of said jamb member passages being adapted for alignment with one of said frame member passages, each of said frame member passages and jamb member passages being adapted for receiving therein a shaft of a bolt member substantially transverse to said flanges through which said frame member passages and jamb member passages extend, wherein said frame member plate portion has a pair of side edges and a longitudinal groove in each of said side edges and wherein said jamb member plate portion has a pair of side edges and a longitudinal groove in each of said side edges.

* * * * *